US011800909B2

(12) United States Patent
Pesce

(10) Patent No.: US 11,800,909 B2
(45) Date of Patent: Oct. 31, 2023

(54) GAIT CORRECTION TREADMILL AND FOOTWEAR SYSTEM

(71) Applicant: Olivia Pesce, Lake Zurich, IL (US)

(72) Inventor: Olivia Pesce, Lake Zurich, IL (US)

( * ) Notice: Subject to any disclaimer, the term of this patent is extended or adjusted under 35 U.S.C. 154(b) by 212 days.

(21) Appl. No.: 17/523,468

(22) Filed: Nov. 10, 2021

(65) Prior Publication Data

US 2022/0142290 A1 May 12, 2022

Related U.S. Application Data

(60) Provisional application No. 63/111,773, filed on Nov. 10, 2020.

(51) Int. Cl.
*A43B 3/34* (2022.01)
*A63B 22/02* (2006.01)
(Continued)

(52) U.S. Cl.
CPC ..... *A43B 3/34* (2022.01); *A63B 21/005* (2013.01); *A63B 21/4015* (2015.10);
(Continued)

(58) Field of Classification Search
CPC ..... A43B 3/34; A43B 5/0454; A63B 21/4015; A63B 21/4035; A63B 21/005; A63B 22/02; A63B 24/0062; A63B 2024/0093; A63B 2209/08; A63B 2220/56; A63B 2220/836; A61B 5/112; A61B 5/1038; A61B 5/11; A61B 5/6807; A61B 5/4082; A61B 2505/09; A61H 3/00; A61H 2201/164; A61H 1/0262; A61H 2203/0406; A61H 2201/1261; A61H 2201/1652
See application file for complete search history.

(56) References Cited

U.S. PATENT DOCUMENTS 6,645,126 B1 11/2003 Martin et al.
6,689,075 B2 * 2/2004 West ..... A61H 1/0262 482/69
(Continued)

FOREIGN PATENT DOCUMENTS

WO WO-2008088142 A1 * 7/2008 ..... A63B 21/00192

*Primary Examiner* — Sundhara M Ganesan
*Assistant Examiner* — Jacqueline N L Loberiza
(74) *Attorney, Agent, or Firm* — Boudwin Intellectual Property; Daniel Boudwin

(57) ABSTRACT

A gait correction treadmill and footwear system includes a treadmill having a base, a rotating belt, and a harness device that extends upwardly from the front end of the treadmill overtop the rotating belt. Each shoe includes a wearable upper portion with pressure sensors and a control circuit between the insole, as well as electromagnets between the lower end of the insole and the shoe tread. The pressure sensors are configured to map the pressure layout of the wearer's step. The electromagnets interact with a magnetic plate disposed beneath the rotating belt. The heel ends of the shoes include a cable that connects to an adjustable harness device affixed to the treadmill. The system is configured to adjust the harness device to relieve pressure when the wearer steps and to adjust the strength of the electromagnets, thereby increasing or decreasing the force of the user's step to correct their gait.

10 Claims, 6 Drawing Sheets

(51) Int. Cl.

| | |
|---|---|
| ***A63B 21/005*** | (2006.01) |
| ***A63B 24/00*** | (2006.01) |
| ***A63B 21/00*** | (2006.01) |

(52) U.S. Cl.

CPC ..... *A63B 21/4035* (2015.10); *A63B 22/02* (2013.01); *A63B 24/0062* (2013.01); *A63B 2024/0093* (2013.01); *A63B 2209/08* (2013.01); *A63B 2220/56* (2013.01); *A63B 2220/836* (2013.01)

(56) References Cited

U.S. PATENT DOCUMENTS

| | | | | |
|---|---|---|---|---|
| 7,125,388 | B1 | 10/2006 | Reinkensmeyer et al. | |
| 8,968,163 | B1 | 3/2015 | Vidmar | |
| 2006/0052728 | A1 | 3/2006 | Kerrigan et al. | |
| 2016/0321947 | A1* | 11/2016 | Toronto ..... | G09B 19/003 |
| 2020/0410892 | A1* | 12/2020 | Otsuki ..... | G09B 19/003 |

* cited by examiner

GAIT CORRECTION TREADMILL AND FOOTWEAR SYSTEM

CROSS REFERENCE TO RELATED APPLICATIONS

This application claims the benefit of U.S. Provisional Application No. 63/111,773, filed on Nov. 10, 2020. The above identified patent application is herein incorporated by reference in its entirety to provide continuity of disclosure.

BACKGROUND OF THE INVENTION

The present invention relates to gait correction treadmill and footwear system. More specifically, the present invention provides a gait correction treadmill and footwear system that actively monitors the user's gait via pressure sensors in the shoes and automatically adjusts the strength of the electromagnets and the positioning of a harness device to adjust the user's gait.

Many individuals suffer from medical issues that arise from improper gait. Other medical problems can themselves cause the individual to develop an abnormal gait, improper gait can cause pain to the muscles, bones, joints, and tendons in the lower body if not addressed and corrected. If an individual walks or otherwise moves continuously in an improper or unnatural gait, injuries may build up over time. In the case of physical rehabilitation to assist patients with regaining control and function of the legs, it is extremely important to establish a natural gait with proper weight shifting that does not become detrimental over time.

Without proper instruction, it can be difficult or impossible for an individual to know if their gait can be corrected. Resources exist for self-diagnosing gait issues, but they can be difficult and time consuming to put into practice. While attempting to correct their gait, individuals may accidentally form habits that end up exacerbating the issue. In order to address these concerns, the present invention provides a gait correction system and method that utilizes a suspension treadmill with adjustable resistance or attraction capabilities to automatically correct the gait of the user.

Devices have been disclosed in the known art that relate to gait correction systems and methods. These include devices that have been patented and disclosed in patent application publications. However, the devices in the known art have several drawbacks. These devices are typically limited to suspension devices utilizing a traditional treadmill. The lack of adjustability of the belt makes it difficult to correct the user's gait. This process can be more time consuming and difficult due to the constant monitoring of the gait and manual correction that is required. Further, the devices in the known art lack a pair of shoes that sense the user's step pattern and connect to the treadmill to facilitate the adjustment of a magnetic attraction force between the shoe and the treadmill.

In light of the devices disclosed in the known art, it is submitted that the present invention substantially diverges in functional and design elements from the known art and consequently it is clear that there is a need in the art for an improvement to gait correction systems and methods. In this regard, the present invention substantially fulfills these needs.

SUMMARY OF THE INVENTION

The present invention provides a gait correction treadmill and footwear system wherein the some can be utilized for sensing a user's gait pattern and automatically adjusting various parameters to help correct the user's gait. The gait correction treadmill and footwear system includes a treadmill having a base, a rotating belt, a magnetic plate disposed beneath the rotating belt, an adjustable harness, a harness actuator, and a controller operably connected to the rotating belt and the adjustable harness. The system further includes a pair of shoes, wherein each shoe includes a pressure sensor and an electromagnet operably connected to a control circuit embedded within the shoe. A cable removably connects the shoe to the adjustable harness and operably connects the shoe control circuit to the treadmill controller.

The treadmill controller includes a processor, a non-transitory computer readable medium operatively connected to the processor, and a logic stored in the non-transitory computer readable medium that, when executed by the processor, causes the system to perform a method. The treadmill controller receives foot pressure data from the shoe pressure sensor and analyzes the pressure data to determine if less step force or more step force is required for gait correction. The controller can then activate the harness actuator to adjust a position of the harness, and can also transmit a control communication to adjust a magnetic field strength of the electromagnet of the shoe, such that the shoe control circuit affects the change in the electromagnet. In this way, the system can balancing the opposing forces of the harness and the electromagnetics to help automatically adjust the user's gait as they walk or run on the treadmill belt.

One object of the present invention is to provide a gait correction treadmill and footwear system that automatically corrects the user's gait, without the user having to manually adjust or input information.

Another object of the present invention is to provide a gait correction treadmill and footwear system that has adjustable electromagnetics that repel against a magnetic plate in the treadmill, such that the strength of the magnets corresponds to the ideal force with which the user steps on the treadmill.

A further object of the present invention is to provide a gait correction treadmill and footwear system that includes a harness that creates an upward force opposing the force of the user's step, in order to selectively reduce the force with which the user steps on the treadmill.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
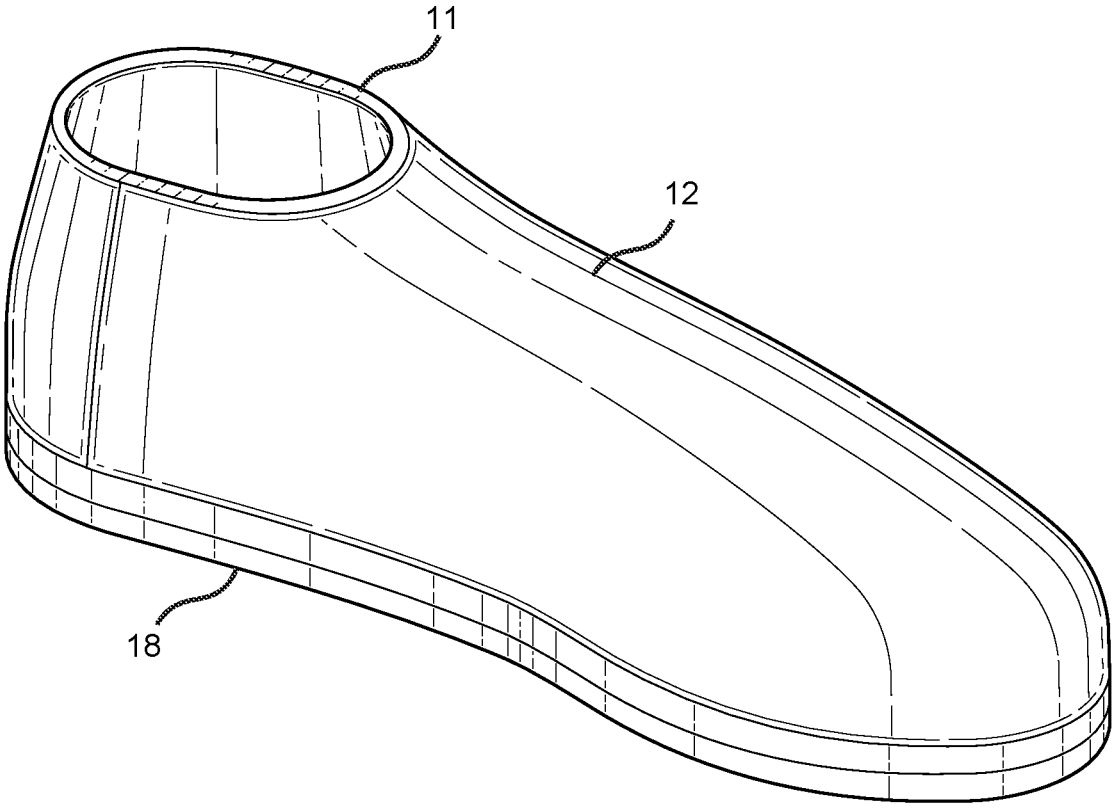
FIG. 1 shows a perspective view of the shoe component of an embodiment of the gait correction treadmill and footwear system.

According to some embodiments, the operations, techniques, and/or components described herein can be implemented as (i) a special-purpose computing device having specialized hardware and a logic hardwired into the computing device to persistently perform the disclosed operations and/or techniques or (ii) a logic that is implementable on an electronic device having a general purpose hardware processor to execute the logic and a computer-readable medium, e.g. a memory, wherein implementation of the logic by the processor on the electronic device provides the electronic device with the function of a special-purpose computing device.

In the interests of economy, the present disclosure refers to "a computer-readable medium," "a processor," and so on. However, this should not be read as limiting in any way as the present disclosure contemplates embodiments of the present invention utilizing "one or more computer-readable media," "one or more processors," and so on. Unless specifically limited to a single unit, "a" is intended to be equivalent to "one or mere" throughout the present disclosure. As used herein, the term "processor" can refer to any electronic circuit which performs operations on some external source. As used herein, the term "logic" can include any combination of computer software instructions, integrated circuit based logic gates, switch or junction-based logic gates, etc. As used herein, the term "memory" can refer to any non-transitory computer readable medium, including but not limited to simple circuit states via logic gates or switch positions, as well as solid state computer readable storage.

According to some embodiments, the operations, techniques, and/or components described herein can be implemented by an electronic device, which can include any combination of digital and analogue circuitry, as well as one or more special-purpose computing devices. The special-purpose computing devices can be hard wired to perform the operations, techniques, and/or components described herein, or can include digital electronic devices such as one or more application-specific integrated circuits (ASICs) or held programmable gate arrays (FPGAs) that are persistently programmed to perform the operations, techniques and/or components described herein, or can include one or more general purpose hardware processors programmed to perform such features of the present disclosure pursuant to program instructions in firmware, memory, other storage, or a combination. Such special-purpose computing devices can also combine custom hard-wired logic, ASICs, or FPGAs with custom programming to accomplish the technique and other features of the present disclosure. The special-purpose computing devices can be desktop computer systems, portable table computer systems, handheld devices, networking devices, or any other device that incorporates hard-wired and/or program logic to implement the techniques and other features of the present disclosure.

Reference is made herein to the attached drawings. Like reference numerals are used throughout the drawings to depict like or similar elements of the gait correction treadmill and footwear system, for the purposes of presenting a brief and clear description of the present invention, the present invention will be discussed as being used for automatically sensing and correcting gait issues for the user. The figures are intended for representative purposes only and should not be considered to be limiting in any respect.

Referring now to FIG. 1, there is shown a perspective view of the shoe component of an embodiment of the gait correction treadmill and footwear system. The shoe 11 generally includes an upper portion 12 and a tread portion 18. The shoe 11 can have any style of construction. For example, the shoe 11 may be laceless as shown, or may include laces. The outward appearance in general can vary. The shoe can be universal or sized specifically to fit a particular user's foot.

Figure 2:
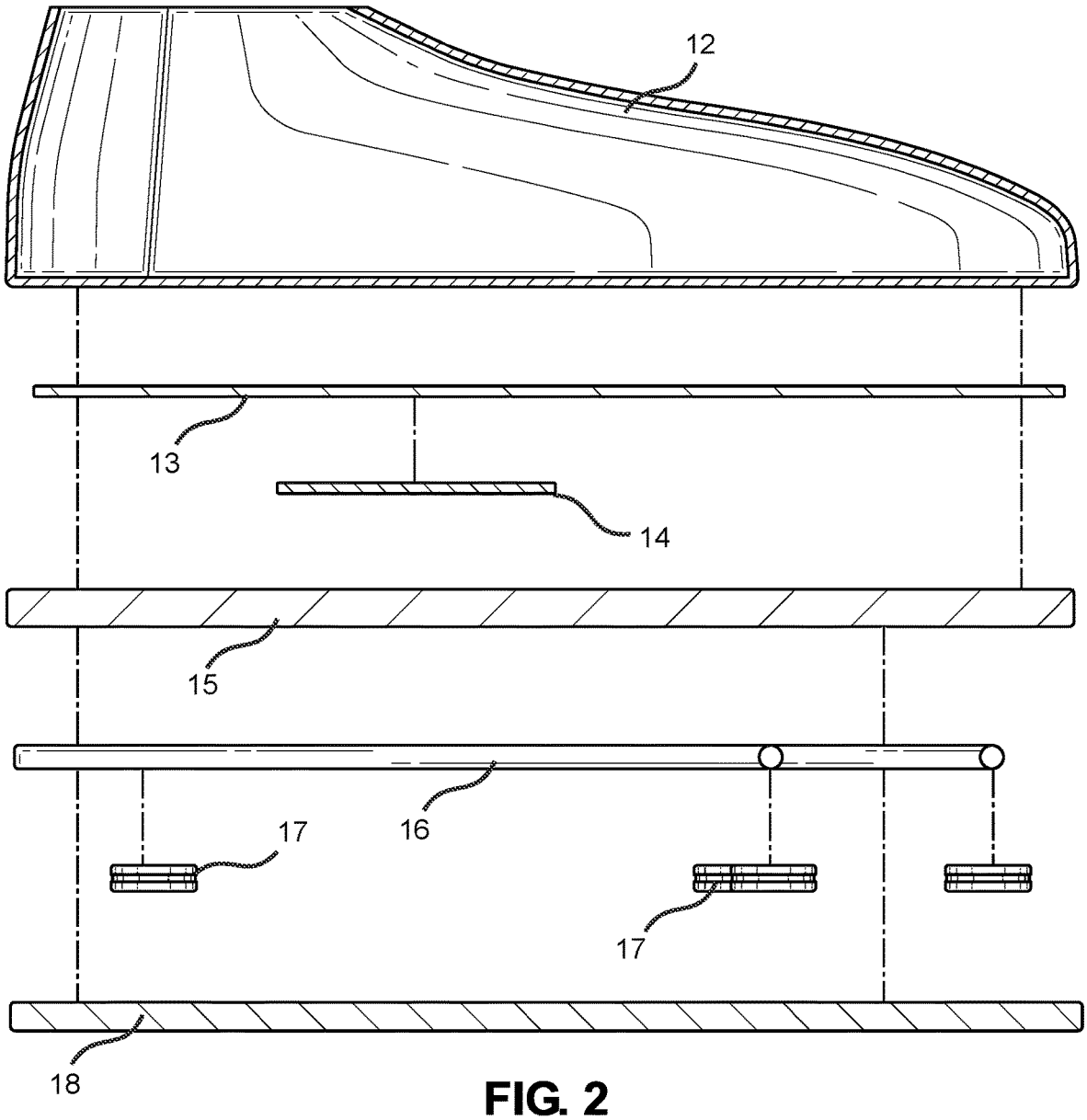
FIG. 2 shows an exploded side elevation view of the shoe component of an embodiment of the gait correction treadmill and footwear system.

Referring now to FIG. 2, there is shown an exploded side elevation view of the shoe component of an embodiment of the gait correction treadmill and footwear system. The shoe generally includes a pressure sensor 13 and a control circuit 14, which may be a PCB or other similar computing device. The pressure sensor 15 may include multiple sensors spanning the area of the insole 15. The pressure sensors 13 are configured to map the pressure applied across different areas of the foot, when the user takes a step while wearing the shoe. Further, electromagnets 17 are disposed between the insole 15 and outer tread 18 of the shoe. The electromagnets 17 may be connected via one or more connecting wires 16. The connecting wires 16 may also connect ether electronic components of shoe to one another, such as the PCB or control circuit 14 for example.

Figure 3:
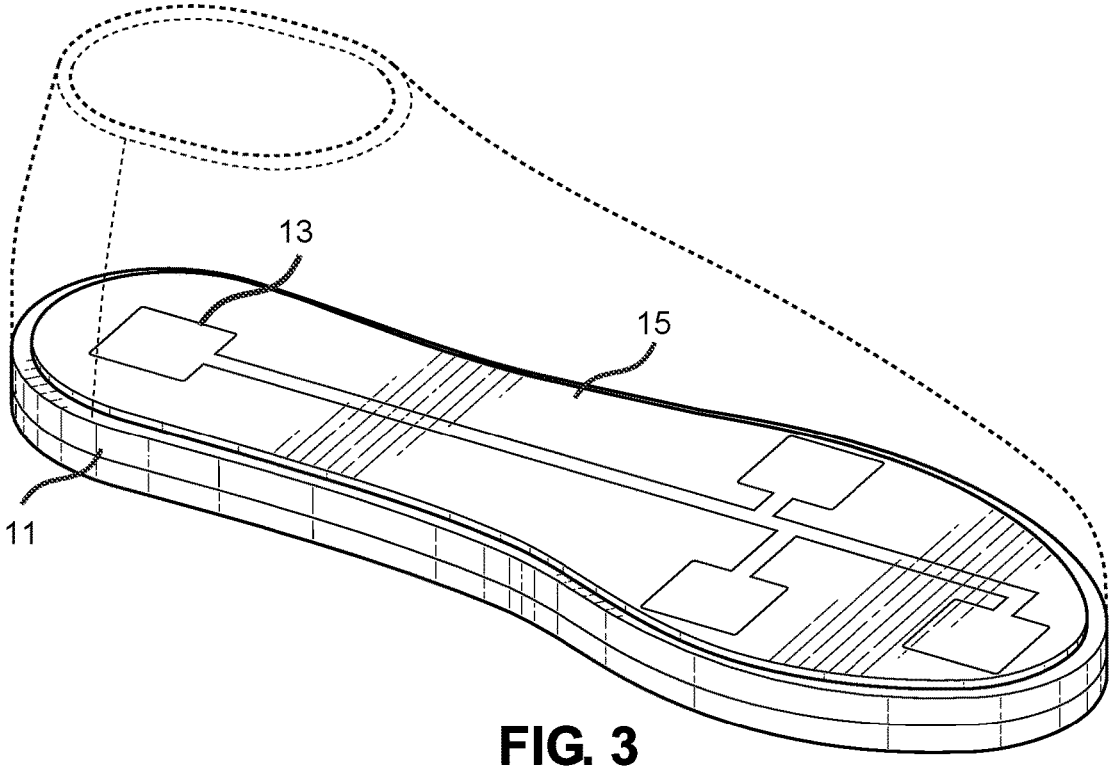
FIG. 3 shows a perspective view of the shoe component of an embodiment of the gait correction treadmill and footwear system detailing the pressure sensors.

Referring now to FIG. 3, there is shown a perspective view of the shoe component of an embodiment of the gait correction treadmill and footwear system detailing the pressure sensors. The pressure sensors 13 can be positioned in specific locations within the insole 15 in order to properly analyze the pressure map and therefore the gait of the user. For example, the shoe 11 can include one pressure sensor 13 in the heel, another pressure sensor 13 in the forefoot or arch area, and additional pressure sensors 13 toward the toe area. This allows the shoe 11 to analyze the distribution of pressure across the foot as the user walks or runs. This information can correspond to different gait corrections that can be made to alter the user's gait in real time.

Figure 4:
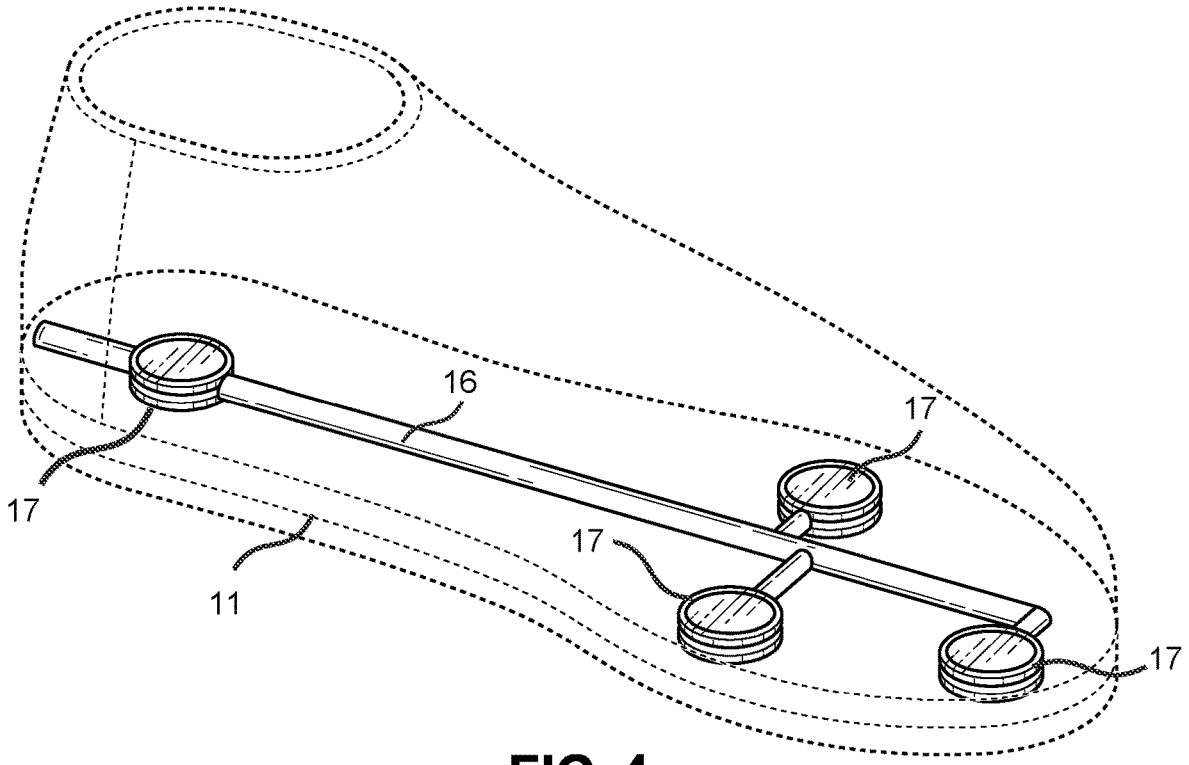
FIG. 4 shows a perspective view of the shoe component of an embodiment of the gait correction treadmill and footwear system detailing the electromagnets.
Figure 5:
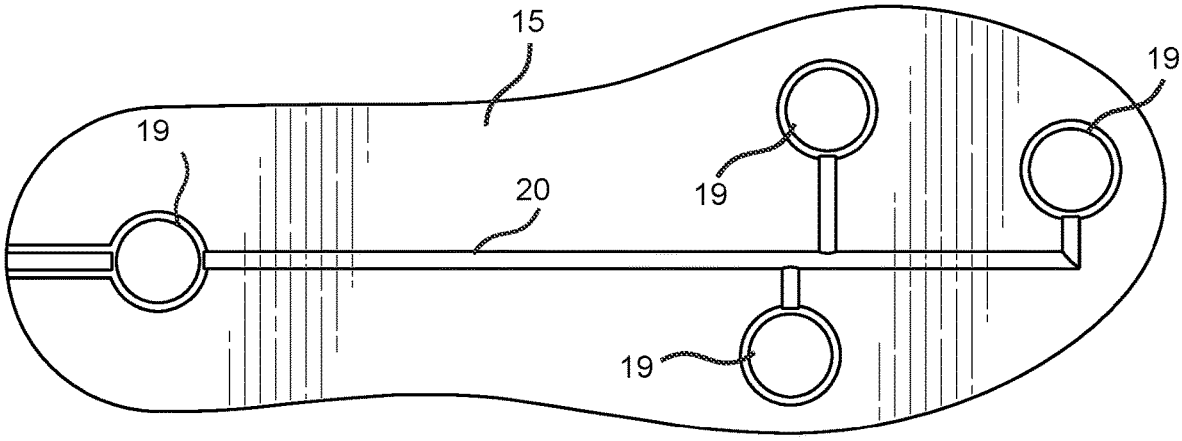
FIG. 5 shows a top plan view of the shoe tread and electromagnets of an embodiment of the gait correction treadmill and footwear system.

Referring now to FIGS. 4 and 5, there are shown perspective and top plan views of the electromagnets of an embodiment of the gait correction treadmill and footwear system. The electromagnets 17 within the shoe 11 interact with a magnetic plate within the treadmill component of the system. The control circuit is operably connected to the electromagnets 17 via connecting wireless 16 or via a wireless connection in other embodiments. The control circuit is configured to automatically adjust the magnetic field strength of each electromagnet 17 independently. The electromagnets 17 interact with the magnetic plate of the treadmill, and adjusting the magnetic field strength changes the attractive force between the plate and the electromagnets 17. This allows the system to determine an ideal field strength to create an attractive force that helps to correct particular gait issues. In the embodiment shown in FIG. 5, the insole 15 includes indents 19, 20 that receive and secure the electromagnets 19 and connecting wire in place. This also allows the electromagnets 19 to be removed or rearranged as desired, potentially creating different patterns for varying the way the treadmill affects the user as they walk or run.

Figure 6:
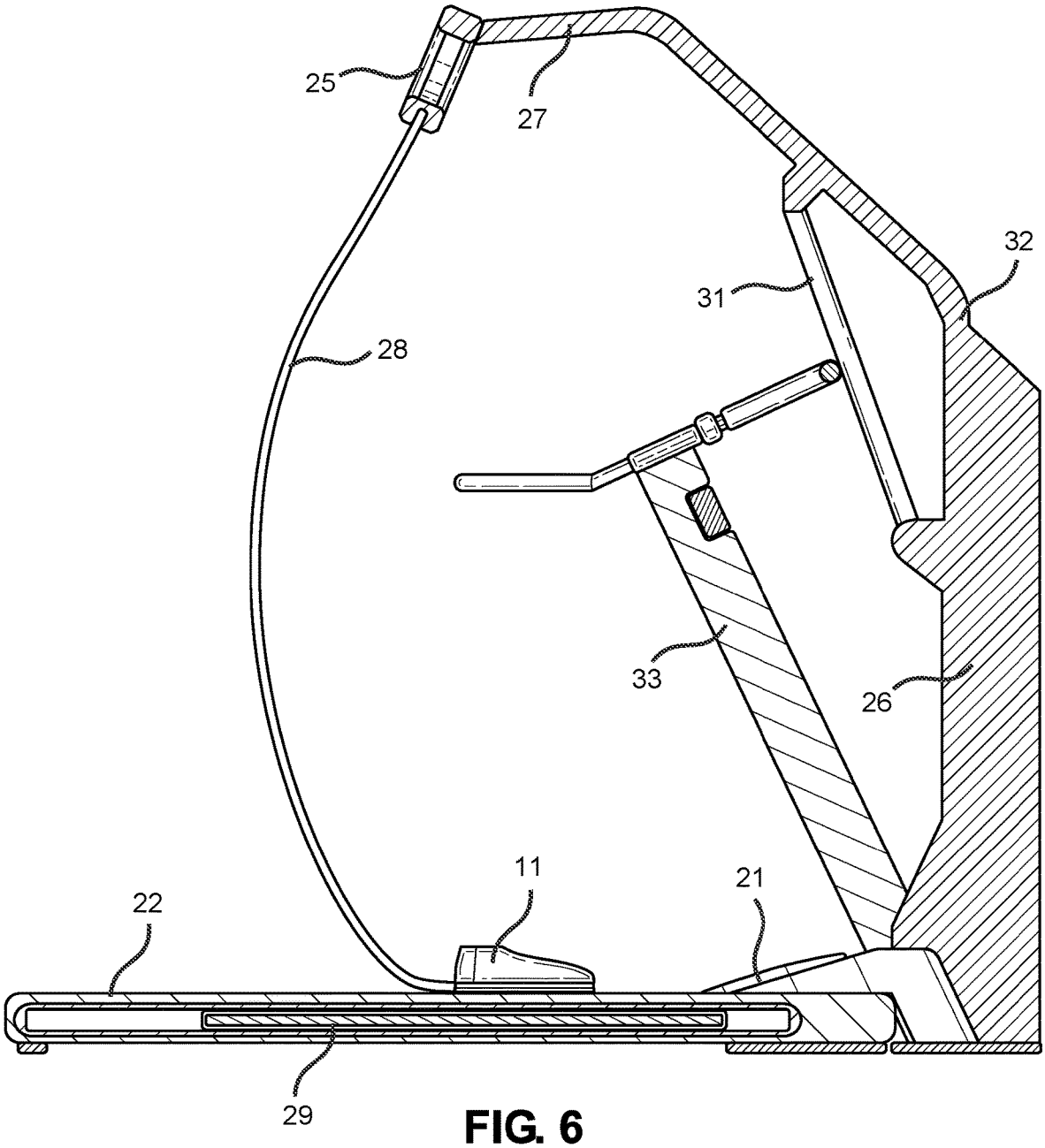
FIG. 6 shows a side elevation view of an embodiment of the gait correction treadmill and footwear system.
Figure 7:
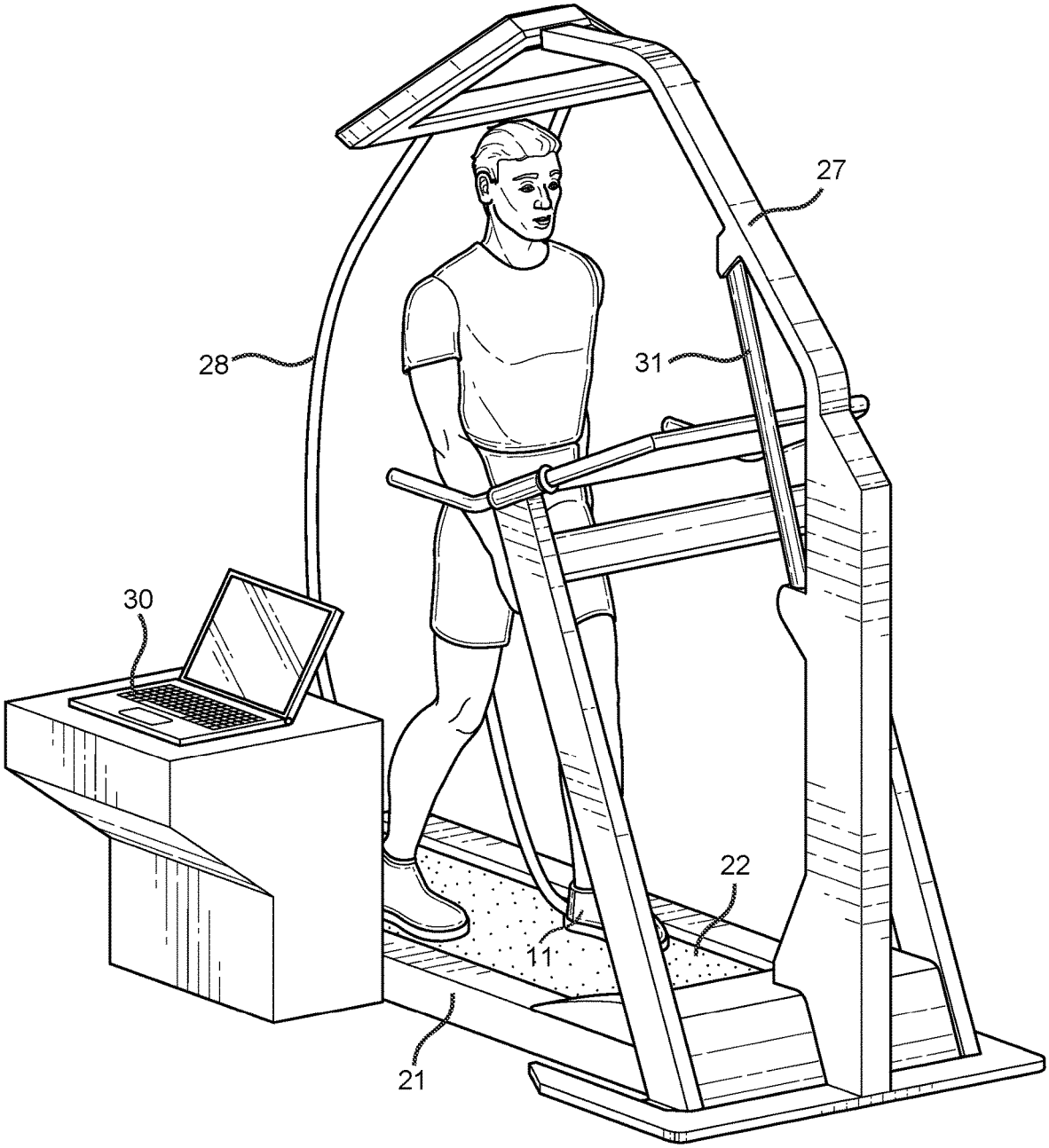
FIG. 7 shows a perspective view of an embodiment of the gait correction treadmill and footwear system in use.

Referring now to FIGS. 6 and 7, there are shown side and perspective views of an embodiment of the gait correction treadmill and footwear system in use. The treadmill 21 includes a rotating belt 22 and a magnetic plate 29 disposed beneath the rotating belt 22. In the shown embodiment, the treadmill 21 also includes a user support 31 that includes a pair of handles. An adjustable harness 25 adjacent the user support 31 includes a base 26 and a support arm 27 that extends rearwardly over the rotating belt 22. The harness 25 connects to a cable 28 at one end, which in turn connects to the shoe 11 at its other end. The harness 25 is adjustable, which can increase or decrease the amount of force the cable 28 imparts to the shoe 11. In some embodiments, the cable 28 allows the shoe 11 to be electrically connected to the treadmill systems. In the shown embodiment, the harness actuator 31 is a linear actuator that can adjust the position of the arm 27 above a pivot point 32 with respect to the base 26. This allows the harness device 25 to raise and lower to adjust the force between the cable 28 and the shoe 11.

A controller 30 is operably connected to the rotating belt and the adjustable harness, and controls the operation of the treadmill and shoe system. The controller 30 includes at least a processor, a non transitory computer readable medium operatively connected to the processor, and a logic stored in the non-transitory computer readable medium that, when executed by the processor, causes the system to perform a method. First, the controller 30 receives pressure data from the shoe's pressure sensors. This data can be transmitted wirelessly or via a wired connection through the cable 28 that, connects the shoe 11 to the harness 25. The controller 30 is configured to analyze the pressure data to determine if less step force or more step force is required for gait correction. The controller 30 can then activating the harness actuator to adjust a position of the harness 25 accordingly, which adjusts how the cable 28 interacts with the shoe 11. The cable 28 connects to the heel end of the shoe 11 in the shown embodiment. As an example, the harness 25 can be adjusted upwardly so that the cable 28 pulls on the heel end of the shoe 11 when the user applies too much pressure or too much of a heel strike while walking or running on the belt 22.

The controller 30 is further configured to transmit a control communication to the control circuit of the shoe 11 in order to adjust a magnetic field strength of the electromagnet of the shoe. In this way, the shoe control circuit affects the change in the electromagnet. For example, the pressure sensors may show that additional pressure should be applied to the forefoot while the user is walking. The electromagnet aligned with the user's forefoot can be increased in strength to provide an increased attractive force between the electromagnet and the magnetic plate 29. This draws the forefoot of the user toward the plate 29 with each step. Repetition of this motion will assist the user in making proper contact while walking or running and developing a proper gait over time. The combination of the pressure sensors mapping the pressure of different areas of the foot, the electromagnets being adjustable in strength, and the harness being adjustable in height to adjust the cable tension, all allows for automatic adjustment of the system to train the user in a proper gait.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, and an equivalent relationships to those illustrated in the drawings and described in the specification are intended to be encompassed by the present invention. Therefore, the foregoing is considered as illustrative only of the principles of the invention. Further, it is not desired to limit the invention to the exact construction and operation shown and described, and accordingly, all suitable modifications and equivalents may be resorted to, falling within the scope of the invention.

I claim:

1. A gait correction treadmill and footwear system comprising:

a treadmill having a base, a rotating belt, a magnetic plate disposed beneath the rotating belt, an adjustable harness, a harness actuator, and a controller operably connected to the rotating belt and the adjustable harness;

a shoe having a pressure sensor and an electromagnet operably connected to a control circuit;

a cable removably connecting the shoe to the adjustable harness and operably connecting the shoe control circuit to the treadmill controller;

the treadmill controller comprising a processor, a non-transitory computer readable medium operatively connected to the processor, and a logic stored in the non-transitory computer readable medium that, when executed by the processor, causes the system to perform a method, the method comprising:

receiving pressure data from the shoe pressure sensor;

analyzing the pressure data to determine if less step force or more step force is required for gait correction; and either one of or both of:

activating the harness actuator to adjust a position of the harness; and transmitting a control communication to adjust a magnetic field strength of the electromagnet of the shoe, such that the shoe control circuit affects the change in the electromagnet.

2. The gait correction tread mill and footwear system of claim 1, wherein the electromagnet, is embedded between a tread of the shoe and a lower end of a sole of the shoe.

3. The gait correction treadmill and footwear system of claim 1, wherein the electromagnet comprises a plurality of electromagnets connected via one or more electrical wires.

4. The gait correction treadmill and footwear system of claim 1, wherein the electromagnet is disposed within an indent within an insole of the shoe.

5. The gait correction treadmill and footwear system of claim 1, wherein the pressure sensor comprises a pressure plate disposed between an upper portion of the shoe and a tread of the shoe.

6. The gait correction treadmill and footwear system of claim 1, wherein the treadmill further comprises a control terminal including a display and one or more input controls.

7. The gait correction treadmill and footwear system of claim 1, wherein the adjustable harness comprises a support attached to a front end of the treadmill and an arm extending upwardly from an upper end of the support and toward a rear end of the treadmill.

8. The gait correction treadmill and footwear system of claim 7, wherein the arm of the adjustable harness is pivotally connected to the support, and wherein the harness actuator comprises a linear actuator configured to adjust an angle of the arm with respect to the support.

9. The gait correction treadmill and footwear system of claim 1, wherein the cable is configured to removably secure to a heel portion of the shoe.

10. The gait correction treadmill and footwear system of claim 1, wherein the treadmill further comprises a user support platform positioned adjacent the harness support, the support platform comprising a pair of handles.

* * * * *